United States Patent [19]

Bakhshi

[11] Patent Number: 5,008,131

[45] Date of Patent: Apr. 16, 1991

[54] METHOD AND APPARATUS FOR IMPREGNATING A POROUS SUBSTRATE WITH FOAM

[75] Inventor: Shiv K. Bakhshi, Columbus, Ohio

[73] Assignee: Owens-Corning Fiberglas Corporation, Toledo, Ohio

[21] Appl. No.: 388,283

[22] Filed: Jun. 14, 1982

[51] Int. Cl.[5] ..... B05D 1/26; B05D 3/06; B05C 3/00; B05C 3/18

[52] U.S. Cl. ..... 427/209; 427/243; 8/477; 68/200; 118/44; 118/410; 118/411; 118/415

[58] Field of Search ..... 68/200; 118/411, 50, 118/44, 410, 412, 415; 427/244, 294, 296, 243, 209, 373; 8/477

[56] References Cited

U.S. PATENT DOCUMENTS

| | | | |
|---|---|---|---|
| 3,084,661 | 4/1963 | Roberts | 118/50 |
| 3,533,834 | 10/1970 | Marzocchi | 427/296 |
| 3,969,780 | 7/1976 | Henderson | 8/149.1 |
| 4,023,526 | 5/1977 | Ashmus et al. | 118/410 |
| 4,188,355 | 2/1980 | Graham et al. | 264/26 |
| 4,237,818 | 12/1980 | Clifford et al. | 118/410 |
| 4,288,475 | 9/1981 | Meeker | 427/294 |
| 4,305,169 | 12/1981 | Vidalis | 118/410 X |

OTHER PUBLICATIONS

"Foam Processing for Dyeing and Finishing", Shirley Institute Publication S42, Apr. 15, 1981, Didsbury, Manchester, U.K.

*Primary Examiner*—Evan K. Lawrence

*Attorney, Agent, or Firm*—Ted C. Gillespie; Michelle N. Lester

[57] ABSTRACT

A method and apparatus for impregnating a pourous substrate with foam the method comprising transporting the porous substrate through a nip region defined by a moving foraminous surface such as a rotating foraminous drum and a foam discharge head, the foam discharge head comprising one or more discharge openings, where the transport of the porous substrate through the nip region causes the porous substrate to be compressed as it passes the discharge openings, and supplying foam to the discharge head with pressure sufficient to discharge foam through the discharge openings to impregnate the porous substrate. A surface support conveyor is positioned between the foraminous surface and the porous substrate.

29 Claims, 1 Drawing Sheet

METHOD AND APPARATUS FOR IMPREGNATING A POROUS SUBSTRATE WITH FOAM

TECHNICAL FIELD

This invention pertains to treating a porous substrate by impregnating the substrate with a foam. In one of its more specific aspects, this invention relates to transporting a porous substrate past an applicator which injects foam into the porous substrate, thereby impregnating or coating the porous substrate.

BACKGROUND OF THE INVENTION

A common practice in the manufacture of porous substrates is to apply a coating of various materials thereto. In the manufacture of carpet material, for example, it is necessary to dye the carpet to the desired color during the manufacturing process. Also, many types of fibrous and non-fibrous webs or blankets require a binder to bond the fibers or other particles together to form a cohesive product. An example of this is an insulation pack produced by bonding together mineral fibers, such as glass fibers. A typical binder for a glass fiber insulation pack is a phenol-formaldehyde-urea binder. The binder is applied to the fibers, and, when cured, the binder enables the insulation pack to be compressed with nearly full recovery upon release of the compression.

Previously, the application of binder, dye or any other coating material to porous substrates, such as carpets or mineral fiber webs, has been by one of several methods. The common method in the manufacture of mineral fiber packs is to spray a binder material or coating material onto the fibers prior to collecting the fibers in the form of an insulation pack. This process has certain deficiencies in that the binder has to be applied in a hot fiber-forming zone, thereby creating air pollution problems. Also, binder application onto air-borne fibers is inherently non-uniform. Another process for applying coatings to porous substrates is that of transporting the substrate through a liquid bath, such as is used to dye fabrics, including carpets. This process is deficient in that a large percentage of water or other carrier medium remains in the porous substrate after the coating process, and must be removed by costly methods, such as by drying ovens. Also, liquid bath applicators provide no control of penetration of the liquid into the substrate.

Another method for coating porous substrates is that of creating a foam containing the coating material, such as the binder or the dye, and impregnating the porous material with the foam. The use of the foam material facilitates a uniform coating on all the material of the substrate, and applies the coating with a minimum amount of carrier medium, such as water. Typically, the foams are applied as a layer to the substrate, and caused to impregnate the substrate by the use of a doctor blade. A process for forcing a layer of foam into a porous substrate is disclosed in U.S. Pat. No. 4,188,355, to Graham et al., which provides for a suction apparatus to force the binder foam into the insulation pack. The use of a suction device to force the foam into the pack is not entirely satisfactory, however, and is made more difficult by the inherent difficulty in transporting a fragile pack of fibers through a narrow opening and past a foam applicator. Also, suction devices are limited in not being able to produce any pressures higher than one atmosphere. There is a need for a method and apparatus for applying foam to a porous substrate in the absence of a vacuum apparatus, which is inherently pressure limited.

SUMMARY OF THE INVENTION

There has now been developed a method and apparatus for applying foam to a porous substrate in which the substrate is passed through a nip region defined by a foraminous surface and the surface plate of a foam discharge head. The function of the foraminous surface is to press the insulation material down tight against the surface plate and the discharge openings, thereby sealing the surface plate and insuring that the foam will pass directly into the insulation pack rather than leaking along the interface between the surface plate and the insulation pack. Such a pressure device has two requirements. First, it must not create so much friction between the insulation material and the surface plate that the insulation material cannot be transported past the foam discharge head. The friction which can be tolerated by any particular porous substrate is a function of the tensile strength of that porous substrate. Also, the foraminous nature of the surface enables air to escape from the pack during the compression process. The pressurized foam is able to partially or fully impregnate the insulation pack, and the urging of the substrate into sealed relation with the surface plate at the nip region insures that the foam material will pass through the surface and into the interior of the insulation pack rather than travel along the interface between the insulation pack and the discharge head. The method and apparatus of this invention can apply foams at very high pressures, and are not limited to sub-atmospheric pressures. Also, the invention can be used to apply foam to substrates having very low tensile strengths, since the substrate is driven by the foraminous surface. Further, a greater control of the penetration of the foam can be effected with the present invention.

According to this invention, there is provided apparatus for impregnating a porous substrate with a foam comprising a foam discharge head having a surface plate adapted with one or more discharge openings for the discharge of foam therefrom, a foraminous surface positioned opposite the discharge openings to define a nip region having a thickness less than the thickness of the porous substrate, with the foraminous conveyor being adapted to transport the porous substrate through the nip region and to urge, with the foam discharge head, the porous substrate into sealed relation with the surface plate at the nip region, and means for supplying foam to the foam discharge head with pressure sufficient to impregnate the porous substrate.

In specific embodiment of the invention, the means for supplying foam supplies foam to the foam discharge head at a pressure within the range of from about 3 to about 18 psig.

In another specific embodiment of the invention, the means for supplying foam supplies foam to the foam discharge head at a pressure within the range of from about 5 to about 10 psig.

In a preferred embodiment of the invention, a radio-frequency dryer removes water from the porous substrate subsequent to its being impregnated with foam.

In a more preferred embodiment of the invention, a second foraminous surface and a second foam discharge head are adapted to discharge foam through another side of the porous substrate.

In another specific embodiment of the invention, the discharge openings comprise a plurality of holes positioned in the surface plate. The holes can be arranged in rows, with the holes in one row being offset or staggered with respect to its adjacent row.

In another specific embodiment of the invention, a surface support conveyor is positioned between the foraminous surface and the porous substrate.

According to this invention, there is also provided apparatus for impregnating a fibrous web with a foam comprising a foam discharge head having a surface plate adapted with one or more discharge openings for the discharge of foam therefrom, a rotatably mounted foraminous drum positioned opposite the discharge openings to define a nip region, with the foraminous drum being adapted to transport the fibrous material through the nip region, and the foraminous drum being adapted to urge, with the foam discharge head, the fibrous web into sealed relation with the surface plate so that foam is prevented from accumulating at the interface between the foam discharge head and the fibrous web as it is transported through the nip region, and means for supplying foam to the foam discharge head with pressure sufficient to impregnate the fibrous web. The web can be a web of mineral fibers, and the foam can be a binder foam supplied by a foamer.

In a specific embodiment of the invention, the nip region has a minimum thickness within the range of from about 5 to about 20 percent of the thickness of the fibrous web when uncompressed.

In a preferred embodiment of the invention, the foraminous surface is convex within the nip region in the direction of the foam discharge head.

According to this invention, there is also provided a method for impregnating a porous substrate with a foam comprising transporting the porous substrate through a nip region defined by a foraminous surface and a foam discharge head, the foam discharge head including a surface plate having one or more discharge openings, where the transport of the porous substrate through the nip region causes the porous substrate to be urged into sealed relation with the surface plate as the substrate passes the discharge openings, and supplying foam to the discharge head with pressure sufficient to impregnate the porous substrate.

In another specific embodiment of the invention, water is removed from the porous substrate with a radio-frequency dryer subsequent to impregnating the substrate with foam.

In a preferred embodiment of the invention, one side of the porous substrate is impregnated with the first foraminous conveyor and first foam discharge head, and the other side of the porous substrate is impregnated with a second foraminous conveyor and a second foam discharge head.

In another preferred embodiment of the invention, the discharge openings comprise at least 2 rows of holes, with the holes in one row being offset with respect to its adjacent row.

In another embodiment of the invention, two or more porous substrates are simultaneously impregnated with foam by being passed in laminated form through the nip region. In such a case, the porous substrates, which could be of a textile fabric, could be laid one on top of another to form a bonded or unbonded laminate which then could be fed into the nip region for impregnation with foam. Such a method would provide greater uniformity of foam application than previous foam application methods for textiles.

According to this invention, there is also provided a method for impregnating a fibrous web with a foam comprising transporting the web through a nip region defined by a rotating foraminous drum and a foam discharge head, the foam discharge head having a surface plate adapted with one or more discharge openings, where the transport of the web through the nip region urges the web into sealed relation with the surface plate to prevent foam from accumulating at the interface between the foam discharge head and the web as the web passes the discharge openings, and supplying foam to the discharge head with pressure sufficient to impregnate the web. The fibrous web can be a web of mineral fibers and the foam can be a binder foam.

DESCRIPTION OF THE INVENTION

Figures 1, 2, 3, 4:
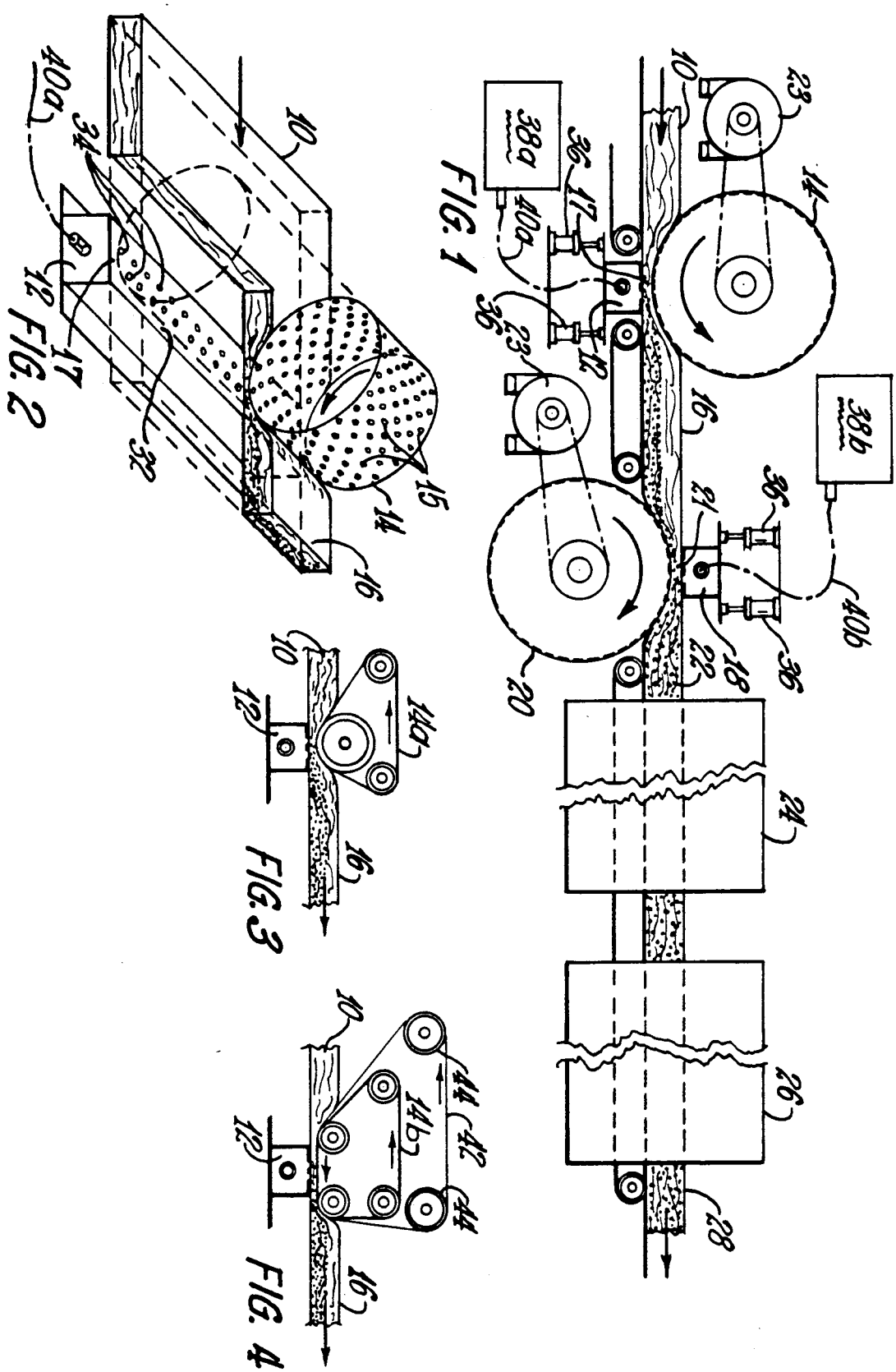
FIG. 1 is a schematic view in elevation of apparatus for impregnating a porous substrate with a foam according to the principles of this invention.
FIG. 2 is a schematic view in perspective of the apparatus shown in FIG. 1.
FIG. 3 is a view in elevation of a different embodiment of the foraminous surface.
FIG. 4 is a view in elevation of yet another embodiment of the foraminous surface.

This invention will be described in terms of a method and apparatus for applying a binder foam to an insulation pack of glass fibers. It is to be understood that the invention can be practiced with other coating materials, such as dyes, sizes, lubricants, finishes, oils, waxes, asphalts, latex materials and paints, and with other porous substrates, such as insulation packs of other mineral fibers, paper products, polymer products, and textile material, such as carpeting.

As shown in FIGS. 1 and 2, the unimpregnated porous substrate, such as glass fiber insulation pack 10, is driven past bottom foam discharge head 12 by a foraminous surface, such as first rotating foraminous drum 14. The foraminous drum can be made of any suitable material, such as stainless steel, and is adapted with a plurality of perforations, such as perforations 15. Preferably, the perforations give the drum a porosity of about 0.5. The positioning of the first foraminous drum opposite the foam discharge head defines nip region 17 through which the insulation material must pass. Preferably, the foraminous surface, such as the foraminous drum, is convex within the nip region in the direction of the foam discharge head, i.e., in a downward direction for the apparatus shown in FIG. 2. In the nip region, the insulation material can be considerably compressed, as shown. Preferably, the insulation material is compressed in the nip region to a thickness within the range of from about 5 to about 20 percent of the thickness of the uncompressed insulation material.

The partially impregnated insulation pack 16 can then be drawn past another foam application station, which can be comprised of top foam discharge head 18 and second rotating foraminous drum 20 to produce fully impregnated insulation pack 22. In the alternative, any number of foam application stations can be employed for either the top or bottom (or both) of the porous substrate. As shown in FIG. 2, the nip region 21 is defined by the positioning of the second foraminous drum adjacent the top foam discharge head. The foraminous drums can be driven by any suitable means, such as motors 23. The fully impregnated pack can then be passed through a dryer, such as radio-frequency dryer 24, which can remove water from the impregnated pack without curing the binder. Subsequently, either in an on-line operation or in an off-line operation, the impregnated, dried insulation pack can be passed through a curing station, such as curing oven 26, to produce cured insulation product 28. Alternatively, the dried, uncured insulation material can be molded using conventional wool molding techniques for such uses as automobile hoodliners and headliners.

The foam discharge head is adapted with surface plate 32 across which the insulation pack is transported. Preferably, the surface plate and other parts of the foam discharge heads are comprised of stainless steel, or some other wear-resistant, corrosion-resistant material. The surface plate is adapted with a plurality of discharge openings 34 for dispensing foam from the foam discharge head into the insulation pack. The discharge openings can comprise a single slot, not shown. Preferably, the discharge openings comprise a plurality of holes, and preferably they are arranged in two or more rows, with the holes in one row being offset or staggered from the holes in another row. This provides the most uniform coverage of the foam across the width of the insulation pack, without providing holes so large as to enable the compressed insulation material to be torn by being forced into the holes, or catching on the hole edges. The foam discharge head can be spring-mounted with either hydraulic means, springs or pneumatic means 36 to accommodate solid or incompressible objects, such as glass slugs or density variations in the glass insulation pack, passing through the nip region between the foam discharge head and the foraminous drum. The pneumatic means also accommodate eccentricities in the foraminous drum.

Since the nip region has a minimum thickness less than the thickness of the insulation material, the insulation material is urged into sealed relation to the surface plate so that the foam is prevented from accumulating on the interface of the surface plate and the insulation material. The foam is substantially prevented from leaking or traveling laterally along the surface plate, and is forced to impregnate or penetrate into the insulation material.

The foam discharge heads can be supplied with the binder foam from foamers **38*a* and 38*b* via any suitable means, such as hoses 40*a* and 40*b***. A mechanical foamer that has been found suitable for use for the invention is a 14 inch foamer manufactured by Oakes Corporation, Islip, N.Y. Such a foamer can produce the binder foam at a pressure within the range from about 40 to about 100 psig, or higher. The foam pressure within the foam discharge head is limited only by the construction materials and the foam delivery capacity. Preferably the pressure is within the range of from about 3 to about 18 psig, and most preferably within the range from about 5 to about 10 psig. The pressure reduction from the foamer to the foam discharge head is provided by the hoses, and different size and length hoses can be used to produce the desired pressure drop. The pressure developed in the foam discharge head is dependent on the product produced and on nature of the foam. The foam within the foam discharge head can have a density within the range of 0.01 g/cc to 0.05 g/cc or higher, and preferably, 0.03 g/cc (densities calculated at atmospheric pressure).

As shown in FIG. 3, foraminous surface **14*a*** need not be a rotatable drum, but can follow a path which defines the nip region and seals the insulation pack against the foam discharge head.

Scrim 42 can be directed by scrim transport rolls 44 to lie between foraminous surface **14*b* and the insulation pack as the pack passes through the nip region, as shown in FIG. 4**. The scrim would be advantageous to supplement the tensile strength of the insulation pack.

EXAMPLE

A dry 2-inch thick, 1 pcf glass fiber insulation pack having an initial binder content of 2 percent by weight was subjected to binder foam impregnation according to the principles of this invention. A foam binder material was prepared using an aqueous phenol-formaldehydeurea resin with 2 percent by weight of Union Carbide's TERGITOL NP-10 as a foaming agent, and was applied to the insulation material with the apparatus of this invention using both a bottom and a top application. The minimum thickness of the nip region was about ⅜ inch, the foam pressure in the discharge head was about 5 psig, and the foam density was about 0.03 g/cc. The pressure applied to the insulation pack was about 21 pounds per lineal inch width of the pack. The impregnated pack was placed in a radio-frequency dryer which removed substantially all of the water, resulting in an uncured product having about 20 percent binder by weight. Subsequently, the product was cured in a mold to make a final product having a thickness of about ¾ inch.

It will be evident from the foregoing that various modifications can be made to this invention. Such, however are considered as being within the scope of the invention.

INDUSTRIAL APPLICABILITY

This invention will be found to be useful in the manufacture of packs of mineral fibers for such uses as glass fiber thermal insulation products, and for the manufacture of textile material.

I claim:

1. Apparatus for impregnating a porous substrate with a foam comprising a foam discharge head having a surface plate adapted with one or more discharge openings for the discharge of foam therefrom, a foraminous surface positioned opposite said discharge openings to define a nip region having a thickness less than the thickness of the porous substrate so that the porous substrate is urged into sealed relation with said surface plate so that foam is substantially prevented from accumulating at the interface of said surface plate and the porous substrate as the porous substrate is transported through said nip region, a surface support conveyor positioned between said foraminous surface and the porous substrate, means for driving said foraminous surface to transport the porous substrate through said nip region, and means for supplying foam to said foam discharge head with pressure sufficient to impregnate the porous substrate.

2. The apparatus of claim 1 in which said foraminous surface is a foraminous drum.

3. The apparatus of claims 1 or 2 in which said means for supplying foam supplies foam to said foam discharge head at a pressure within the range of from about 3 to about 18 psig.

4. The apparatus of claim 3 in which said means for supplying foam supplies foam to said foam discharge head at a pressure within the range of from about 5 to about 10 psig.

5. The apparatus of claims 1 or 2 comprising a radio-frequency dryer for removing water from said porous substrate subsequent to its being impregnated with foam.

6. The apparatus of claims 1 or 2 comprising a second foraminous surface and a second foam discharge head adapted to discharge foam through a different side of the porous substrate.

7. The apparatus of claims 1 or 2 in which said discharge openings comprise a plurality of holes positioned in said surface plate.

8. The apparatus of claim 7 in which said holes are arranged in rows with the holes in one row being offset with respect to its adjacent row.

9. Apparatus for impregnating a fibrous web with a foam comprising a foam discharge head having a surface plate adapted with one or more discharge openings for the discharge of foam therefrom, a rotatably mounted foraminous drum positioned opposite said discharge openings to define a nip region, said foraminous drum being adapted to transport the fibrous material through said nip region, and said foraminous drum being adapted to urge, with said foam discharge head, the fibrous web into sealed relation with said surface plate so that foam is substantially prevented from accumulating at the interface between said surface plate and the fibrous web as it is transported through said nip region, a surface support conveyor positioned between said foraminous drum and the fibrous web, and means for supplying foam to said foam discharge head with pressure sufficient to impregnate the fibrous web.

10. Apparatus for impregnating a web of mineral fibers with a binder comprising a foam discharge head having a surface plate adapted with a plurality of discharge openings for the discharge of foam therefrom, a rotatably mounted foraminous drum positioned opposite said discharge openings to define a nip region, said foraminous drum being adapted to transport the fibrous material through said nip region, and said foraminous drum being adapted to urge, with said foam discharge head, the web into sealed relation with said surface plate so that foam is substantially prevented from accumulating at the interface between said surface plate and the web as it is transported through said nip region, a surface support conveyor positioned between said foraminous drum and the web of mineral fibers, and a foamer for supplying binder foam to said foam discharge head with pressure sufficient to impregnate the web.

11. The apparatus of claim 10 in which said foamer is adapted to supply binder foam to said foam discharge head at a pressure within the range of from about 3 to about 18 psig.

12. The apparatus of claim 11 in which said foamer is adapted to supply binder foam to said foam discharge head at a pressure within the range of from about 5 to about 10 psig.

13. A method for impregnating a porous substrate with a foam comprising transporting the porous substrate through a nip region defined by a foraminous surface and a foam discharge head, said foam discharge head comprising a surface plate having one or more discharge openings, where the transport of the porous substrate through said nip region compresses the porous substrate, thereby pressing the porous substrate into sealed relation with said surface plate to substantially prevent foam from accumulating at the interface between said surface plate and the porous substrate as the porous substrate is transported through said nip region, providing a surface support conveyor positioned between said foraminous surface and the porous substrate, and supplying foam to said discharge head with pressure sufficient to impregnate the porous substrate.

14. The method of claim 13 in which said foraminous surface is convex within said nip region in the direction of said foam discharge head.

15. The method of claim 14 comprising transporting the porous substrate through said nip region by driving said foraminous surface.

16. The method of claim 14 in which said foraminous surface comprises a foraminous drum.

17. The method of claims 13, 14, 15 or 16 in which the foam pressure within said foam discharge head is within the range of from about 3 to about 18 psig.

18. The method of claim 17 in which said foam pressure within said foam discharge head is within the range of from about 5 to about 10 psig.

19. The method of claims 13, 14, 15 or 16 comprising removing water from said porous substrate with a radio frequency dryer subsequent to the impregnation of the substrate with foam.

20. The method of claims 13, 14, 15 or 16 comprising impregnating one side of the porous substrate with said foraminous surface and said foam discharge head, and impregnating the other side of the porous substrate with a second foraminous surface and a second foam discharge head which function in the same manner as said foraminous surface and said foam discharge head.

21. The method of claims 13, 14, 15 or 16 in which said discharge openings comprise at least 2 rows of holes, with the holes in one row being offset with respect to its adjacent row.

22. The method of claims 13, 14, 15 or 16 comprising simultaneously impregnating two or more porous substrates with foam by passing the porous substrates in laminated form through said nip region.

23. The method of claims 13, 14, 15 or 16 comprising compressing said porous substrate within said nip region to a thickness within the range of from about 5 to about 20 percent of the thickness of the porous substrate.

24. A method for impregnating a fibrous web with a foam comprising transporting the web through a nip region defined by a rotating foraminous drum and a foam discharge head, said foam discharge head having a surface plate adapted with one or more discharge openings, where the transport of the web through said nip region compresses the web, thereby pressing the web into sealed relation with said surface plate to substantially prevent foam from accumulating at the interface between said foam discharge head and the web as it is transported through said nip region, providing a surface support conveyor positioned between said foraminous drum and the fibrous web, and supplying foam to said discharge head with pressure sufficient to impregnate the web.

25. A method for impregnating a carpet material with a foam comprising transporting the carpet material through a nip region defined by a rotating foraminous drum and a foam discharge head, said foam discharge head comprising a surface plate adapted with one or more discharge openings, where the transport of the carpet material through said nip region compresses the carpet material, thereby pressing the carpet material into sealed relation with said surface plate to substantially prevent foam from accumulating at the interface between said foam discharge head and the carpet as it is transported through said nip region, providing a surface support conveyor positioned between said foraminous drum and the carpet material, and supplying foam to said discharge head with pressure sufficient to impregnate the carpet material.

26. A method for impregnating a web of mineral fibers with a binder foam comprising transporting the web through a nip region defined by a rotating foraminous drum and a foam discharge head, said foam discharge head comprising a surface plate adapted with a plurality of discharge openings, where the transport of the web through said nip region compresses the web, thereby pressing the web into sealed relation with said surface plate to substantially prevent the binder foam from accumulating at the interface between said foam discharge head and the web as it is transported through said nip region, providing a surface support conveyor positioned between said foraminous drum and the web of mineral fibers, and supplying binder foam to said discharge head with pressure sufficient to impregnate the web.

27. The method of claim 26 comprising compressing the fibrous web within the nip region to a thickness within the range of from about 5 to about 20 percent of thickness of the fibrous web.

28. The method of claim 26 in which the foam pressure within said foam discharge head is within the range of from about 3 to about 18 psig.

29. The method of claim 28 in which said foam pressure within said foam discharge head is within the range of from about 5 to about 10 psig.

* * * * *